US005335956A

United States Patent [19]

Panossian

[11] Patent Number: 5,335,956

[45] Date of Patent: Aug. 9, 1994

[54] PUCK OR BALL CARRIER

[76] Inventor: Raffy Panossian, P.O. Box 20534, Cambridge, Ontario, Canada, N3C 2V6

[21] Appl. No.: 153,978

[22] Filed: Nov. 18, 1993

Related U.S. Application Data

[63] Continuation-in-part of Ser. No. 885,981, May 20, 1992.

[51] Int. Cl.[5] ..... B65D 71/00

[52] U.S. Cl. ..... 294/161; 294/146; 294/166; 211/14; 224/919

[58] Field of Search ..... 294/19.2, 87.1, 99.1, 294/137, 142, 143, 145, 146, 148, 159-163, 165, 166; 206/315.9, 445, 485; 211/14; 224/919; 273/32 D

[56] References Cited

U.S. PATENT DOCUMENTS

| | | | |
|---|---|---|---|
| 1,911,256 | 5/1933 | Andrew | 224/919 X |
| 3,497,118 | 2/1970 | Najjar | 211/14 X |
| 4,026,449 | 5/1977 | Kevin | 294/161 |
| 4,840,332 | 6/1989 | Hoyt | 224/919 X |

FOREIGN PATENT DOCUMENTS

| | | | |
|---|---|---|---|
| 797071 | 10/1968 | Canada . | |
| 967607 | 5/1975 | Canada . | |
| 1056343 | 6/1979 | Canada . | |
| 1122170 | 4/1982 | Canada . | |
| 457154 | 11/1936 | United Kingdom | 294/19.2 |

*Primary Examiner*—Johnny D. Cherry
*Attorney, Agent, or Firm*—Robert G. Hendry; Robert A. Wilkes

[57] ABSTRACT

A carrier for circular articles such as hockey pucks, baseballs, softballs, golf balls, tennis balls, and the like, of integral construction in resilient material comprises an elongated hollow body having two side walls, a rear wall, and a partially open front wall. The rear wall has holes regularly spaced of a dimension to receive a portion of the circular object. Narrow flanges which define the partial front wall have notches associated with cooperating holes in the rear wall. The notches define a space to receive a portion of the circular object. The object is held in place secured by the hole in the rear wall and the notches in the front wall. Objects can be introduced or removed by spreading the side walls to permit the object to pass through the partial front wall. The resiliency of the material will then close the carrier securely around the object.

12 Claims, 3 Drawing Sheets

PUCK OR BALL CARRIER

This application is a continuation-in-part of U.S. application Ser. No. 07/885,981 filed May 20, 1992.

BACKGROUND OF THE INVENTION

This invention relates to a carrier for circular objects, especially sporting articles such as balls or pucks. Practice for sports involving balls or pucks generally calls for more than one (ball or puck) allowing repetition of the same movement. Because of their round shape, more than one of these items is difficult to handle. The present invention provides a secure carrier which allows playing pieces to be inserted and removed individually. Although the pieces are loosely trapped in the carrier, the pieces cannot move within the carrier between the available spaces. In different embodiments the carrier is designed to accommodate extra attachments such as a water bottle or other accessories and to be supported by the appropriate hockey stick, bat, racquet, etc. In addition the carrier's one piece plastic construction is simple and inexpensive to manufacture and adds minimal extra bulk. Other carriers of this nature have more complicated structure such as Canadian patent 797,071; or, as shown in Canadian patent 967,607, will only accommodate one playing ball.

Coin holders as shown in Canadian patents 1,056,343 or 1,122,170 disclose a similar structure to the hockey puck model; however, they depend on being fully loaded to work properly. In the structure shown in Najjar (U.S. Pat. No. 3,497,118) and Webster (U.K. 457,154), individual pieces cannot be removed or inserted into individually selected positions. Convenient carrying is another advantage provided in the present invention and not disclosed in other carriers.

Accordingly, this invention provides a carrier for at least one circular object having a diameter comprising an elongate hollow body, C-shaped in cross-section, of resilient material, having two side walls, a rear wall, and an open front wall, the front and rear walls being substantially flat; the front wall being two flanges extending inwardly from each of the side walls substantially parallel to the rear wall; the rear wall joining the side walls; and a trapping means for the or each circular object, allowing the object to be pressed into or removed from the trapping means from the front of the carrier, comprising in combination a hole in the rear wall of a dimension smaller than the diameter of the object; a notch in each of the front wall flanges in opposed relationship, having inwardly facing edges aligned with the hole in the rear wall; wherein the trapping means defines an opening between the notch edges marginally smaller in dimension than the diameter of the object, and a space within the carrier defined by the notch edges, the depth of the side walls, and the hole in the rear wall sufficient to entrap loosely each circular object; whereby the object engages the side edges of the notches to flex apart the side walls when the object is inserted or removed.

Objects can be removed or introduced by forcing the object through the opening between the notches causing the side walls of the hollow body to flex apart wide enough to release or admit a single object. Additional attachment means may be provided for supporting the carrier and for supporting additional accessories on the carrier.

In the accompanying drawings which illustrate the invention:

Figures 7, 7A:
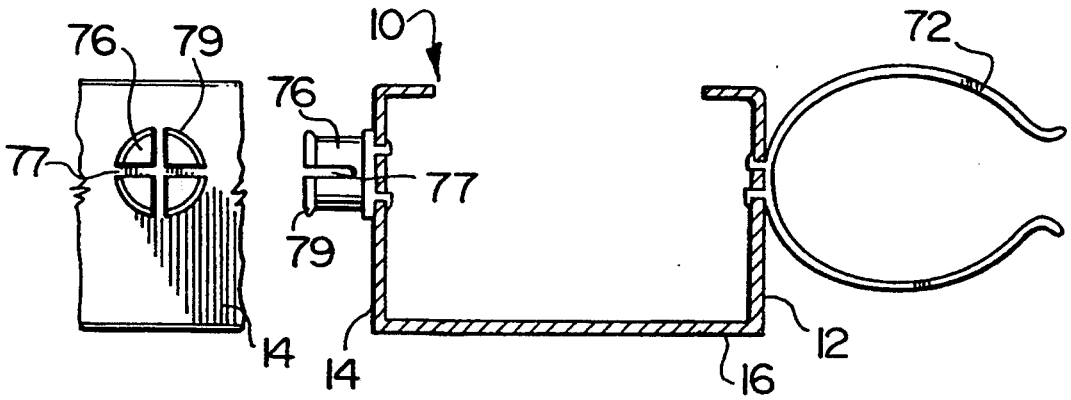
FIG. 7 is a cross section along line 7—7 of FIG. 6.

FIG. 7*a* is a fragmentary side view showing the tape mounting spool.

Figure 1:
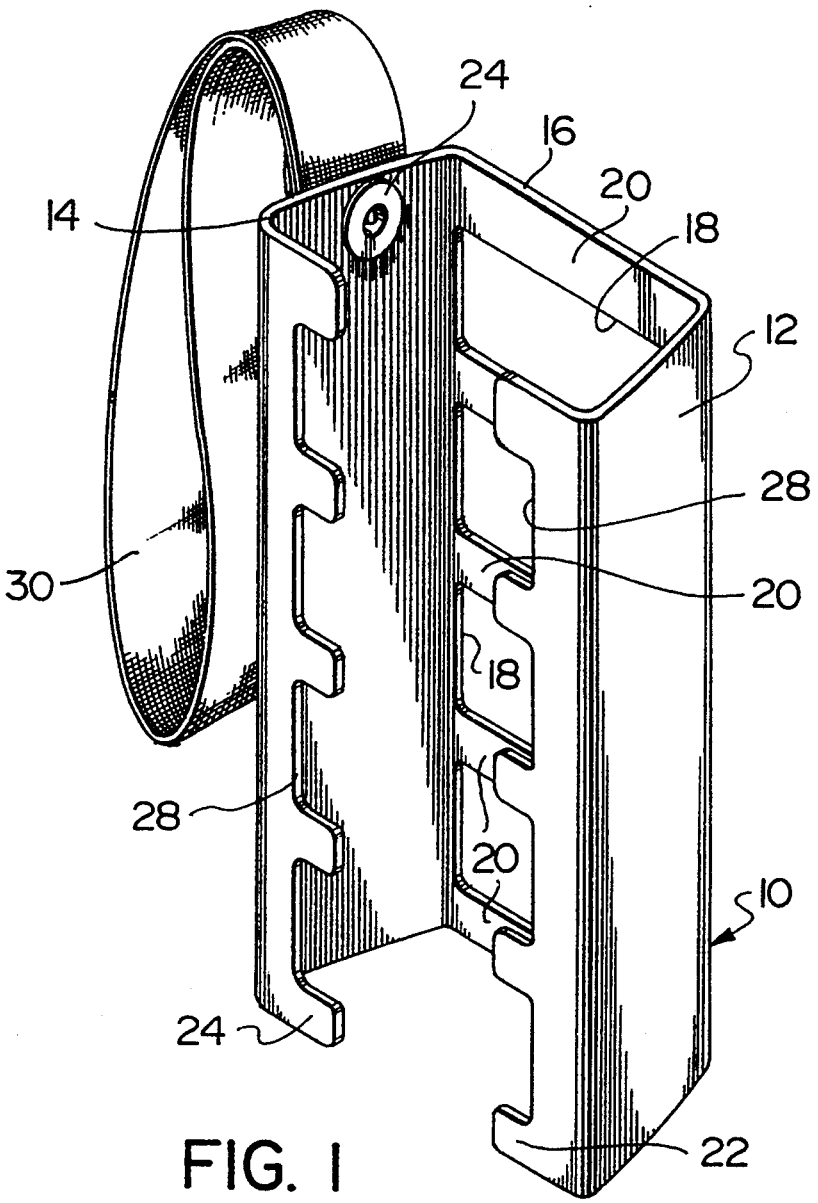
FIG. 1 is a perspective view of a hockey puck carrier.
Figure 2:
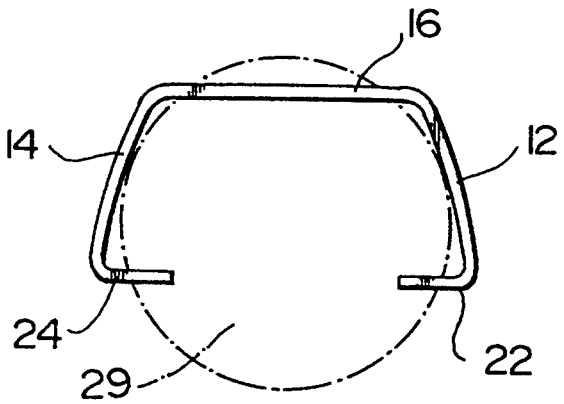
FIG. 2 is a top plan view of the holder of FIG. 1 with a puck shown in phantom within.

Referring now in detail to the drawings, the puck carrier shown at 10 in FIG. 1, is generally of C-shaped cross-section and consists of two side walls 12 and 14 which are flexibly connected by a substantially flat rear wall 16. The rear wall 16 has a plurality of rectangular holes 18 dimensioned to receive a portion of a hockey puck but not of sufficient size to permit a puck to pass through. The holes 18 are spaced apart by transverse wall portions 20 in the rear wall 16. Each of the side walls 12 and 14 has an inwardly extending substantially flat flange 22 and 24 respectively restricting the width of the longitudinal opening. The flanges 22, 24 are substantially parallel to the rear wall 16. The flanges 22 and 24 each have notches 28. These notches 28, which are spaced apart the same distance as, and are in registration with the holes 18, define a space narrower than the diameter of a puck 29 shown in dashed lines in FIG. 2. The carrier is also provided with an optional strap 30 as a handle.

In use a hockey puck 29 is pressed between the notches 28 with a force sufficient to flex apart the side walls 12 and 14. The puck 29 is then loosely trapped in the space defined by the notches 28 and the hole 18 such that a portion of the puck 29 extends through the hole 18 and a portion extends beyond the notches 28. Consequently, each pair of notches 28 and their associated hole 18 define a separate trapping means within which the puck is loosely held. Further, as the puck extends beyond the notches 28 and into the hole 18, once inserted by pressing in from the front, it cannot move along the carrier into another location. The resiliency of the material used in the carrier allows it to return to its original shape once a puck 29 is inserted loosely thus trapping the puck 29 inside. The puck is removed similarly, by either pulling from the front, or pressing out from the back.

Figure 3:
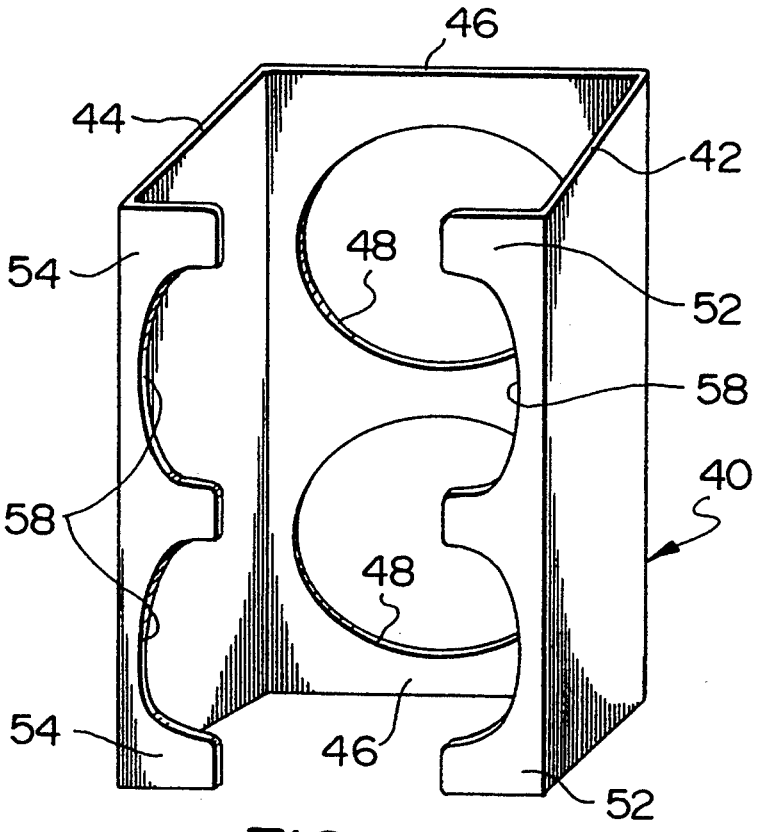
FIG. 3 is a perspective view of a ball carrier.

FIG. 3 shows an alternate embodiment of the carrier designed for small playing balls such as baseballs, softballs or tennis balls. The carrier 40 shown is generally of C-shaped cross-section and consists of two side walls 42 and 44 flexibly connected by a substantially flat rear wall 46. The rear wall 46 has a number of elliptical holes 48, in this case two, dimensioned to receive an appropriate ball, but not large enough to allow it to pass through. Each of the side walls 42 and 44 has an inwardly extending substantially flat flange 52 and 54 restricting the width of the longitudinal opening. The flanges 52 and 54 are cut with curved notches 58 spaced apart the same distance as, and in registration with, the holes 48 in the rear wall 46. These notches 58 define a space somewhat narrower than the diameter of the ball. In use a ball is pressed between the curved notches 58 with a force sufficient to flex apart the side walls 42 and 44. The ball is then trapped in a position such that a portion of the ball extends through the hole 48 and a portion extends beyond the curved notches 58. The resiliency of the material used in the carrier 40 allows it to return to its original shape once a ball is inserted, thus trapping the ball inside. Consequently, as was noted above with the puck carrier, each ball is loosely trapped in an individual space, and cannot move laterally within the carrier to another space.

Figure 4:
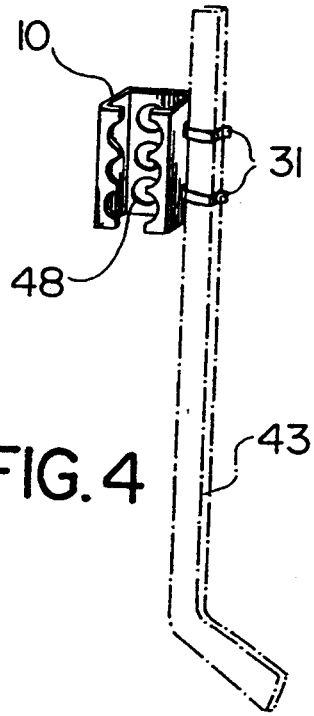
FIG. 4 is a perspective view of an alternative hockey puck carrier with a support shown in use on a hockey stick.

FIG. 4 illustrates an alternate embodiment of the hockey puck carrier shown in FIG. 1. In this embodiment the carrier 10 is provided with attachment means in the form of straps 31 to engage the shaft of a hockey stick 43 for convenient carrying.

Figure 5:
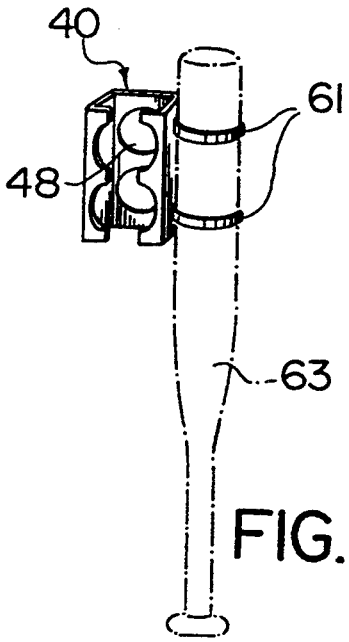
FIG. 5 is a perspective view of an alternative ball carrier with a support shown in use on a bat.

FIG. 5 illustrates an alternate embodiment of the ball carrier 40 shown in FIG. 3. Similar to FIG. 4, in this embodiment the carrier is provided with straps 61 to attach the carrier to a bat 63 allowing for convenient carrying. Similarly, if adapted for tennis balls, the carrier could be supported on a tennis racquet (not shown).

Figure 6:
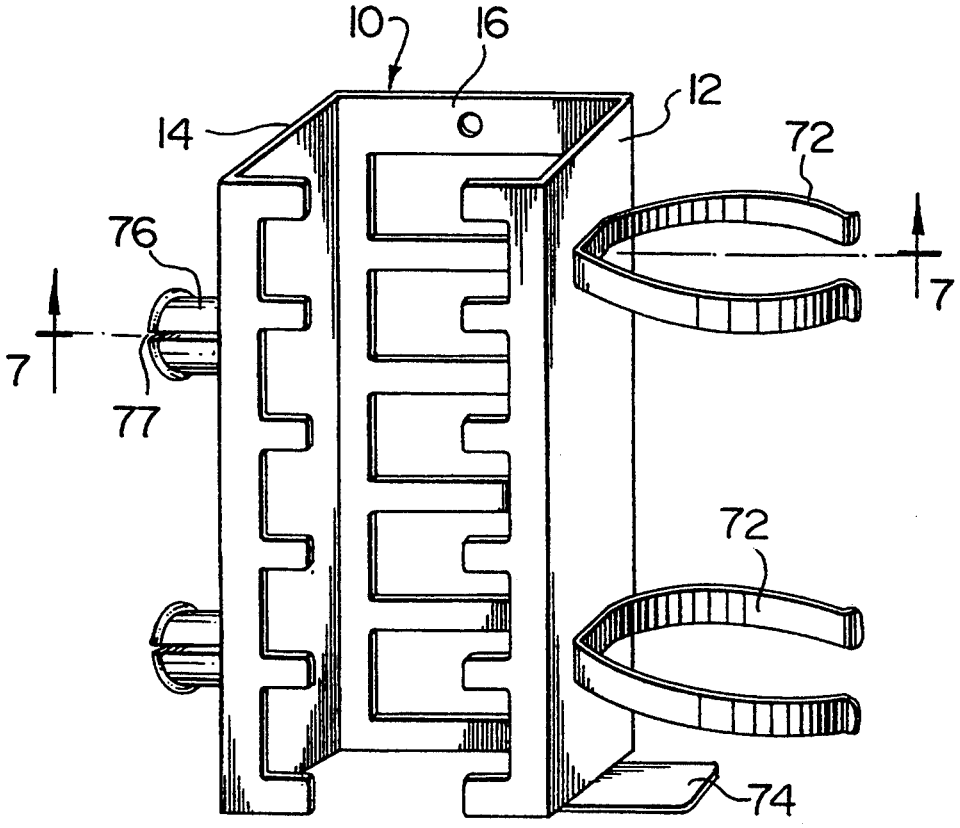
FIG. 6 is a perspective view of an alternative puck carrier provided with supports for accessories.

FIG. 6 shows another embodiment of the hockey puck carrier wherein to the carrier body are attached accessory supports. In this embodiment a bracket means for supporting a water bottle (not shown) includes two partially circular bands 72 of resilient material extending from side wall 12. A shelf 74 extends from the bottom of the side wall 12. This configuration will support a cylindrical water bottle. To the opposite side wall 14 one or more spool means 76 is attached. The spool 76 is cylindrical with cross-cut slots 77 allowing the diameter of the spool 76 to be flexibly compressed. A slightly raised lip 79 extends around the outside edge of spool 76. The spool 76 can be compressed to receive a roll of tape. When the compression is released, the raised lip 79 secures the tape roll in place.

FIG. 7 is a cross-section taken along line 7—7 of FIG. 6 illustrating a partially circular band 72 and the shelf 74 of the water bottle bracket and a tape mounting spool 76 as attached to the carrier 10.

FIG. *7a* is a fragmentary side view illustrating the face of the tape mounting spool means 76 and the cross-cut slots 77.

The embodiments of the invention in which an exclusive property or privilege is claimed are defined as follows:

1. A carrier for at least one circular object having a diameter comprising:

an elongate hollow body, C-shaped in cross-section, of resilient material, having two side walls, a rear wall, and an open front wall; the front and rear walls are substantially flat;

the front wall being two flanges extending inwardly from each of the side walls substantially parallel to the rear wall;

the rear wall joining the side walls; and a trapping means for the or each circular object, allowing the object to be pressed into or removed from the trapping means from the front of the carrier, comprising in combination:

a hole in the rear wall of a dimension smaller than the diameter of the object;

a notch in each of the front wall flanges in opposed relationship, having inwardly facing edges aligned with the hole in the rear wall;

wherein the trapping means defines an opening between the notch edges marginally smaller in dimension than the diameter of the object, and a space within the carrier defined by the notch edges, the depth of the side walls, and the hole in the rear wall sufficient to entrap loosely each circular object;

whereby the object engages the side edges to flex apart the side walls when the object is inserted or removed.

2. A carrier as claimed in claim 1 wherein the rear wall has a plurality of holes, and the flanges have a plurality of notches.

3. A carrier as claimed in claim 1 wherein the holes and notches are regularly spaced apart.

4. A carrier as claimed in claim 1 wherein the hollow body comprises a one-piece resilient plastic moulding.

5. A carrier as claimed in claim 1 wherein each hole in the rear wall is round, and the notches are rounded in shape, to entrap a circular object which is a ball.

6. A carrier as claimed in claim 1 wherein each hole in the rear wall is rectangular, and the notches in the flanges define a rectangular space, to accommodate a hockey puck.

7. A carrier for a plurality of circular objects having a diameter comprising:

an elongate hollow body, C-shaped in cross-section, of resilient material, having two side walls, a rear wall, and an open front wall; the front and rear walls are substantially flat;

the front wall being two flanges extending inwardly from each of the side walls substantially parallel to the rear wall;

the rear wall joining the side walls; and a trapping means for each circular object, allowing the object to be pressed into or removed from the trapping means from the front of the carrier, comprising in combination:

a hole in the rear wall of a dimension smaller than the diameter of the object;

a notch in each of the front wall flanges in opposed relationship, having inwardly facing edges aligned with the hole in the rear wall;

wherein the trapping means defines an opening between the notch edges marginally smaller in dimension than the diameter of the object, and a space within the carrier defined by the notch edges, the depth of the side walls, and the hole in the rear wall sufficient to entrap loosely each circular object;

whereby the object engages the side edges to flex apart the side walls when the object is inserted or removed.

8. A carrier as claimed in claim 7 wherein the holes in the rear wall and the notches in the flanges are regularly spaced apart.

9. A carrier as claimed in claim 7 wherein the hollow body comprises a one-piece resilient plastic moulding.

10. A carrier as claimed in claim 7 wherein each hole in the rear wall is round, and the notches are rounded in shape, to entrap a circular object which is a ball.

11. A carrier as claimed in claim 7 wherein each hole in the rear wall is rectangular and the notches in the flanges define a rectangular space, to accommodate a hockey puck.

12. A carrier as claimed in claim 1 wherein the carrier is provided with a handle.

* * * * *